US010131142B2

(12) United States Patent
Ichikawa

(10) Patent No.: US 10,131,142 B2
(45) Date of Patent: Nov. 20, 2018

(54) INKJET HEAD AND INKJET PRINTER

(71) Applicant: TOSHIBA TEC KABUSHIKI KAISHA, Shinagawa-ku, Tokyo (JP)

(72) Inventor: Masaya Ichikawa, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/602,139

(22) Filed: May 23, 2017

(65) Prior Publication Data

US 2017/0341384 A1 Nov. 30, 2017

(30) Foreign Application Priority Data

May 31, 2016 (JP) ..... 2016-108651

(51) Int. Cl.
*B41J 2/045* (2006.01)

(52) U.S. Cl.
CPC ..... *B41J 2/04588* (2013.01); *B41J 2/04543* (2013.01); *B41J 2/04581* (2013.01); *B41J 2/04586* (2013.01); *B41J 2/04596* (2013.01); *B41J 2202/10* (2013.01)

(58) Field of Classification Search
CPC ..... B41J 2/04508; B41J 2/04541; B41J 2/04543; B41J 2/0459; B41J 2/04591; B41J 2/04573; B41J 2/04581; B41J 2/04586; B41J 2/04588; B41J 2/14201; B41J 2/14241; B41J 2/14274; B41J 2202/10
See application file for complete search history.

(56) References Cited

U.S. PATENT DOCUMENTS

| | | | | |
|---|---|---|---|---|
| 6,099,103 | A * | 8/2000 | Takahashi | B41J 2/04563 347/11 |
| 6,193,343 | B1 | 2/2001 | Norigoe et al. | |
| 6,899,409 | B2 * | 5/2005 | Kusunoki | B41J 2/04581 347/11 |
| 7,195,327 | B2 * | 3/2007 | Kitami | B41J 2/04581 347/10 |
| 7,410,233 | B2 * | 8/2008 | Kitami | B41J 2/04516 347/10 |
| 7,857,406 | B2 * | 12/2010 | Komai | B41J 2/04541 347/10 |
| 7,896,456 | B2 * | 3/2011 | Iwashita | B41J 2/04525 310/324 |
| 8,857,936 | B2 * | 10/2014 | Furuno | B41J 2/04581 347/11 |
| 9,205,647 | B2 * | 12/2015 | Ichikawa | B41J 2/04581 |
| 9,221,249 | B2 * | 12/2015 | Kuki | B41J 2/04581 |
| 2016/0016401 | A1 * | 1/2016 | Hiyoshi et al. | B41J 2/04581 347/10 |

* cited by examiner

*Primary Examiner* — Anh T. N. Vo
(74) *Attorney, Agent, or Firm* — Amin, Turocy & Watson LLP

(57) ABSTRACT

In accordance with an embodiment, an inkjet head comprises a pressure chamber, an actuator and a control section. The pressure chamber houses ink. The actuator is driven to expand or contract the volume of the pressure chamber in order to eject the ink from an opening of the pressure chamber. The control section applies an expansion pulse of which the width is 0.4 times-0.9 times as large as an AT which is half a natural vibration period during which nozzle negative pressure is changed in the pressure chamber and which expands the pressure chamber to the actuator, and applies a contraction pulse which contracts the pressure chamber to the actuator.

20 Claims, 7 Drawing Sheets

INKJET HEAD AND INKJET PRINTER

CROSS-REFERENCE TO RELATED APPLICATIONS

This application is based upon and claims the benefit of priority from Japanese Patent Application No. P2016-108651, filed May 31, 2016, the entire contents of which are incorporated herein by reference.

FIELD

Embodiments described herein relate generally to an inkjet head and an inkjet printer.

BACKGROUND

An inkjet head includes a pressure chamber filled with ink, and an actuator for generating pressure vibration in the pressure chamber. The inkjet head drives the actuator to eject ink from the pressure chamber. There are times when residual vibration after the ejection is undesirably generated in the pressure chamber of the inkjet head due to the ejection of the ink.

There is a problem that the inkjet head generates ejection failure in the subsequent ejection due to the residual vibration.

DETAILED DESCRIPTION

In accordance with an embodiment, an inkjet head comprises a pressure chamber, an actuator and a control section. The pressure chamber houses ink. The actuator is driven to expand or contract the volume of the pressure chamber in order to eject the ink from an opening of the pressure chamber. The control section applies an expansion pulse of which the width is 0.4 times-0.9 times as large as an AT that is half a natural vibration period during which nozzle negative pressure is changed in the pressure chamber and which expands the pressure chamber to the actuator, and applies a contraction pulse which contracts the pressure chamber to the actuator.

Hereinafter, an embodiment is described with reference to the accompanying drawings. An inkjet printer according to the embodiment ejects ink stored in an ink cartridge to a medium (for example, a paper) serving as an adhesion object of ink to form an image on the medium.

Figure 1:
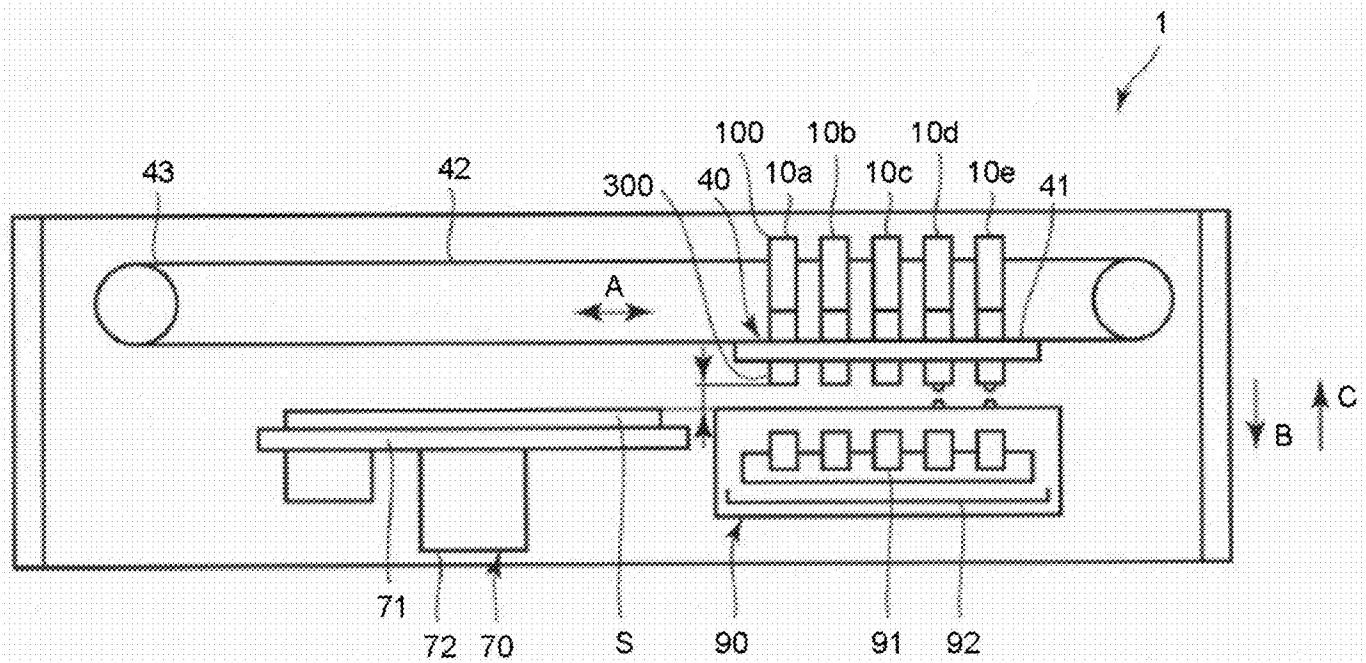
FIG. 1 is a diagram illustrating an example of the constitution of an inkjet printer according to an embodiment.

FIG. 1 is a diagram illustrating an example of the constitution of an inkjet printer 1. The inkjet printer 1 includes a plurality of inkjet head units 10 (10*a* to 10*e*) and ink cartridges that respectively correspond to the plurality of the inkjet head units 10. Further, the inkjet printer 1 includes a head support section 40, a medium moving section 70 (conveyance section) and a maintenance unit 90. The head support section 40 movably supports the plurality of the inkjet head units 10. The medium moving section 70 movably supports a medium S. Furthermore, the number of the inkjet head units 10 included in the inkjet printer 1 is not limited to the specific number.

The inkjet head unit 10 includes an inkjet head 300 serving as a liquid ejection section and an ink circulation device 100 for circulating ink. In a case in which the inkjet printer 1 is a color printer, the ink cartridge of each color communicates with the ink circulation device 100 of the corresponding inkjet head unit 10 via a tube. Each ink cartridge supplies ink to each inkjet head unit 10.

The colors of the ink of the respective inkjet head units 10 may be different from each other. In the color inkjet printer 1, for example, the color of the ink is cyan, magenta, yellow or black.

The head support section 40 conveys and fixes the inkjet head unit 10 to a predetermined position. For example, the head support section 40 includes a carriage 41, a conveyance belt 42 and a carriage motor 43. The carriage 41 supports the plurality of the inkjet head units 10. The conveyance belt 42 reciprocates the carriage 41 in an arrow A direction. The carriage motor 43 drives the conveyance belt.

The medium moving section 70 conveys the medium S on a predetermined conveyance path. For example, the medium moving section 70 includes a table 71 for adsorbing and fixing the medium S. The table 71 is mounted on the upper section of a slide rail device 72 to reciprocate in a direction orthogonal to an arrow A and an arrow B (in a direction orthogonal to the surface of FIG. 1). In other words, the medium moving section 70 reciprocates the table 71 in a direction orthogonal to the carriage 41

The maintenance unit 90 is arranged in a scanning range of the plurality of the inkjet head units 10 in the arrow A direction and at a position outside the moving range of the table 71. The maintenance unit 90 which is a case body with the upper part opened is movably arranged in the vertical direction (in the arrow B direction and the arrow C direction in FIG. 1).

The maintenance unit 90 includes a rubber blade 91 and a waste ink receiving section 92. The blade 91 removes ink, dust or paper powder adhering to a nozzle plate of the inkjet head 300 of the inkjet head unit 10 of each color. The waste ink receiving section 92 receives ink, dust or paper powder removed by the blade 91. The maintenance unit 90 includes a mechanism for moving the blade 91 towards the direction orthogonal to the arrow A and the arrow B. The blade 91 wipes the surface of the nozzle plate.

Figure 2:
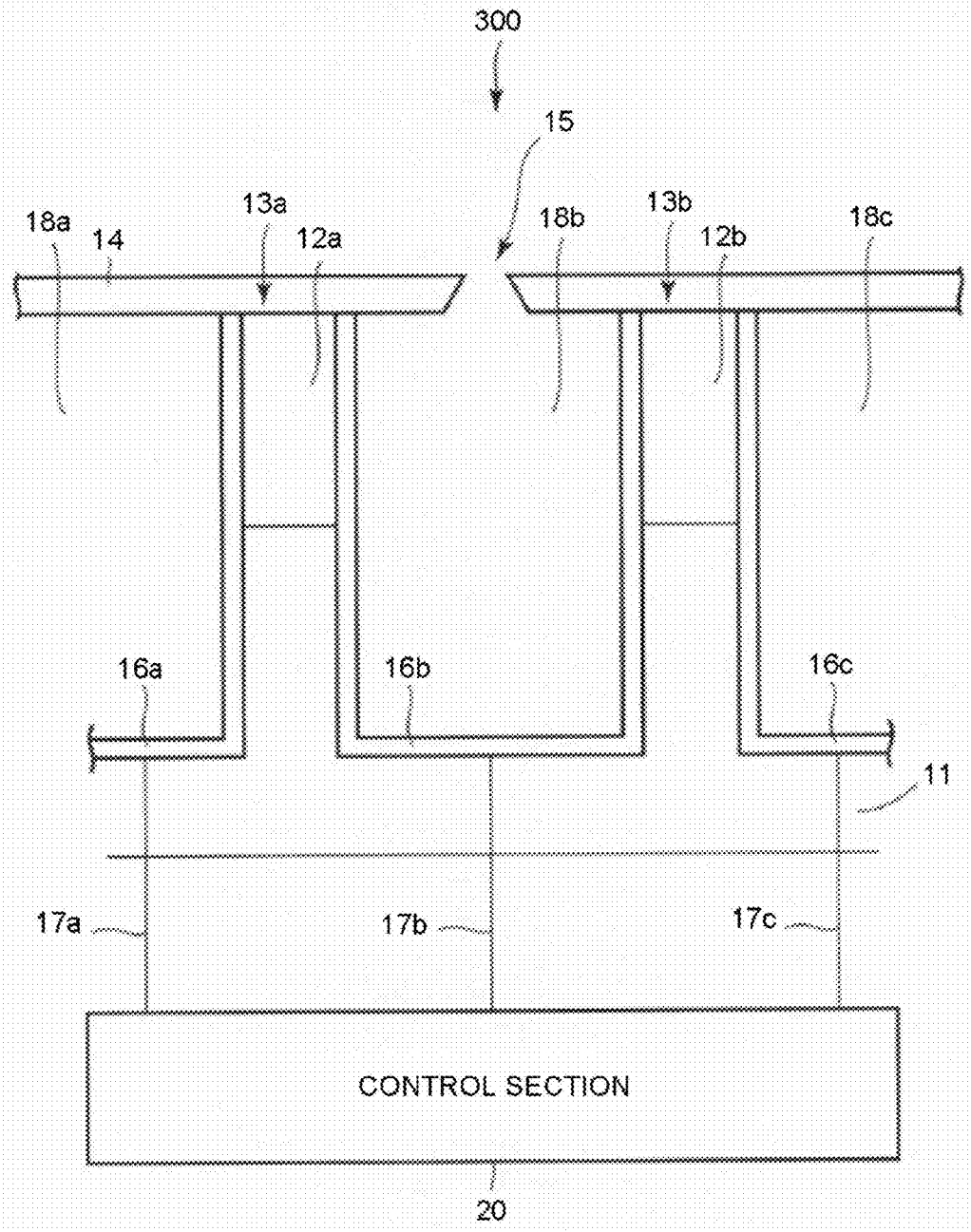
FIG. 2 is a diagram illustrating an example of the constitution of an inkjet head according to the embodiment.

Next, an example of the constitution of the inkjet head 300 is described. FIG. 2 illustrates the example of the constitution of the inkjet head 300. The inkjet head 300 is a side wall type inkjet head in an on-demand type piezoelectric share mode. Further, the inkjet head 300 includes a plurality of ejection holes. The inkjet head 300 divides the plurality of the ejection holes into a plurality of division, and ejects ink for each division. The inkjet head 300 divides the ejection holes into three groups every third ejection hole to carry out division driving, and a case of so-called 3-division driving is exemplified. Further, the inkjet head 300 ejects ink to a medium supplied by the medium moving section 70.

As shown by FIG. 2, the inkjet head 300 includes a first piezoelectric element 11, second piezoelectric elements 12*a* and 12*b*, a nozzle plate 14, electrodes 16*a* to 16*c*, and a control section 20. The inkjet head 300 may further include, for example, a cover, a tube connected to the ink cartridge, and the like.

The inkjet head 300 is a structure in which the first piezoelectric element 11 is bonded to the upper surface of a base substrate (not shown), and the second piezoelectric element 12 is bonded onto the first piezoelectric element 11. Polarization directions of the first piezoelectric element 11 and the second piezoelectric element 12 are opposite to each other. A large number of long grooves are arranged from one end to the other end of the first piezoelectric element 11 and the second piezoelectric element 12. All grooves of which intervals are constant are parallel.

The first piezoelectric element 11 and the second piezoelectric element 12 are constituted by, for example, PZT (Lead Zirconate Titanate). The first piezoelectric element 11 and the second piezoelectric element 12*a* form an actuator 13*a*. Similarly, the first piezoelectric element 11 and the second piezoelectric element 12*b* form an actuator 13*b*.

The nozzle plate 14 is formed on the second piezoelectric element 12. The nozzle plate 14 includes an opening section 15. A pressure chamber 18*b* is formed inside the actuators 13*a* and 13*b* and the nozzle plate 14. The opening section 15 communicates with the pressure chamber 18*b*. Pressure chambers 18*a* and 18*c* are adjacent to the pressure chamber 18*b*, and respectively formed at the actuators 13*a* and 13*b* side.

The pressure chamber 18 houses ink. The pressure chamber 18 includes a supply port for receiving supply of ink from an ink tank in order to fill the ink. The electrodes 16*a* to 16*c* are formed to respectively contact with side walls and bottom surfaces of the pressure chambers 18*a* to 18*c*. In other words, the electrodes 16*a* to 16*c* respectively cover inner surfaces of the pressure chambers 18*a* to 18*c*.

The electrode 16*a* comes into contact with the actuator 13*a* from an outer side of the pressure chamber 18*b*. Further, the electrode 16*b* comes into contact with the actuators 13*a* and 13*b* from inner sides of the pressure chamber 18*b*. Further, the electrode 16*c* comes into contact with the actuator 13*b* from an outer side of the pressure chamber 18*b*.

The actuator 13*a* is formed between the electrode 16*a* and the electrode 16*b*. In other words, if voltages are applied to the electrode 16*a* and the electrode 16*b*, a difference between the two voltages is applied to the actuator 13*a*.

Similarly, the actuator 13*b* is formed between the electrode 16*b* and the electrode 16*c*. In other words, if voltages are applied to the electrode 16*b* and the electrode 16*c*, a difference between the two voltages is applied to the actuator 13*b*.

Leads 17*a* to 17*c* are extended respectively from the electrodes 16*a* to 16*c* to an external device. The leads 17*a* to 17*c* are connected with a control section 20. In other words, the control section 20 can apply drive voltages to the electrodes 16*a* to 16*c* by applying the drive voltages to the leads 17*a* to 17*c*.

Next, the control section 20 of the inkjet head 300 is described. The control section 20 outputs drive voltages to be applied to the electrode 16. For example, the control section 20 outputs an expansion pulse for expanding the pressure chamber 18 and a contraction pulse for contracting the pressure chamber 18 as the drive voltages. Further, a pause period is generated between the expansion pulse and the contraction pulse.

For example, the control section 20 outputs the expansion pulse as follows. The pressure chamber 18*b* is described as an example. The control section 20 outputs a drive signal for driving in a direction in which the volume of the pressure chamber 18*b* is expanded to the actuators 13*a* and 13*b* as the expansion pulse. The expansion pulse is set as a rectangular pulse. For example, the control section 20 applies voltages +VAA to the lead 17*a* and the lead 17*c*, and a voltage −VAA to the lead 17*b*. The actuator 13*a* when the voltage +VAA is applied to the lead 17*a* and the voltage −VAA is applied to the lead 17*b* is applied with a voltage of −VAA*2 by taking the electrode 16*a* as the reference. The actuator 13*a* applied with the voltage of −VAA*2 is driven towards outside (in a direction in which the volume of the pressure chamber 18*b* is expanded).

The actuator 13*b* when the voltage +VAA is applied to the lead 17*c* and the voltage −VAA is applied to the lead 17*b* is applied with to the voltage of −VAA*2 by taking the electrode 16*c* as the reference. The actuator 13*b* applied with the voltage of −VAA*2 is driven towards outside (in a direction in which the volume of the pressure chamber 18*b* is expanded).

Further, For example, the control section 20 outputs the contraction pulse as follows. The control section 20 outputs a drive signal for driving in a direction in which the volume of the pressure chamber 18*b* is contracted to the actuators 13*a* and 13*b* as the contraction pulse. The contraction pulse is set as a rectangular pulse. For example, the control section 20 applies the voltages −VAA to the lead 17*a* and the lead 17*c*, and the voltage +VAA to the lead 17*b*. The actuator 13*a* when the voltage −VAA is applied to the lead 17*a* and the voltage +VAA is applied to the lead 17*b* is applied with a voltage of +VAA*2 by taking the electrode 16*a* as the reference. The actuator 13*a* applied with the voltage of +VAA*2 is driven towards inside (in a direction in which the volume of the pressure chamber 18*b* is contracted).

The actuator 13*b* when the voltage −VAA is applied to the lead 17*c* and the voltage +VAA is applied to the lead 17*b* is applied with the voltage of +VAA*2 by taking the electrode 16*c* as the reference. The actuator 13*b* applied with the voltage of +VAA*2 is driven towards inside (in a direction in which the volume of the pressure chamber 18*b* is contracted).

Positive and negative of the voltage applied by the control section 20 may be opposite in the expansion pulse or the contraction pulse. For example, the positive and negative of the voltage applied by the control section 20 is determined on the basis of structures of the first piezoelectric element 11 and the second piezoelectric element 12 constituting the actuators 13*a* and 13*b*.

The pause period is a period during which the control section 20 does not apply the voltages to the actuators 13*a* and 13*b*. For example, the pause period may be set intentionally by the control section 20. Further, the pause period may be generated unintentionally in structure of the circuit of the control section 20. For example, the pause period is about 0.2 μs.

For example, the control section 20 is constituted by a control signal generation section for generating a waveform pattern of a drive voltage and a transistor for applying voltages to the electrodes 16*a* to 16*c* according to the waveform pattern.

The control section 20 carries out ejection operations as follows. Firstly, the control section 20 expands the volume of the pressure chamber 18*b* to draw a meniscus into the pressure chamber 18*b*. The control section 20 then contracts the volume of the pressure chamber 18*b* to push the meniscus to the outside of the pressure chamber 18*b*. The control section 20 ejects ink from the opening section 15 by pushing the meniscus to the outside of the pressure chamber 18*b*. In other words, the control section 20 applies ejection pulses including the expansion pulse, the pause period and the contraction pulse to the electrodes 16*a* to 16*c* to eject the ink.

Figure 3:
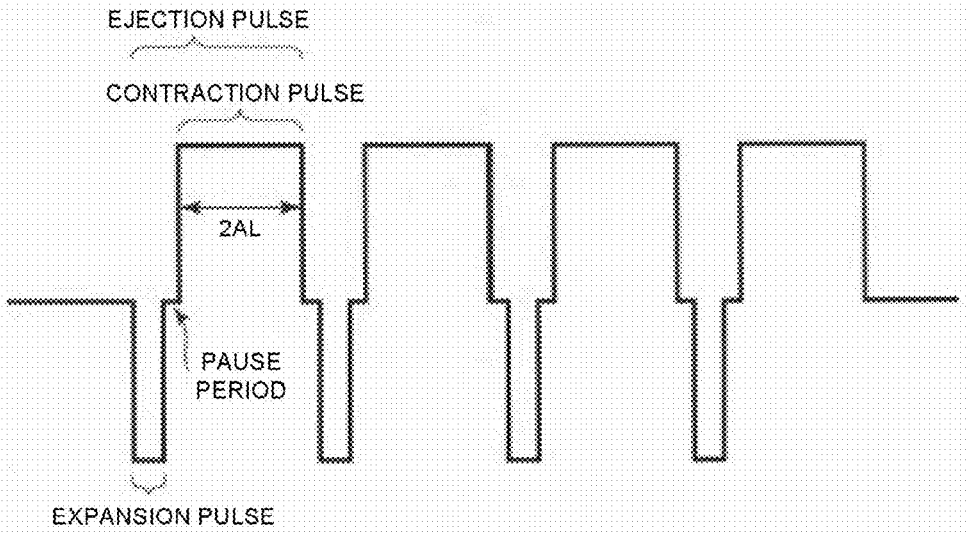
FIG. 3 is a diagram illustrating an example of a voltage waveform applied to an electrode according to the embodiment.

Next, the drive voltage applied to the actuator via the electrodes 16*a* to 16*c* by the control section 20 is described. FIG. 3 is a diagram illustrating an example of the drive voltage applied to the actuator by the control section 20. The example shown by FIG. 3 illustrates the voltages applied to predetermined actuators (for example, the actuators 13*a* and 13*b*) by the control section 20.

As shown by FIG. 3, the control section 20 applies the expansion pulse to the actuator at a predetermined timing. If the expansion pulse is applied, the control section 20 applies the contraction pulse after the pause period elapses. The contraction pulse has a width twice as large as AL. The AL is half a natural vibration period during which nozzle negative pressure is changed in the pressure chamber 18.

Figure 4:
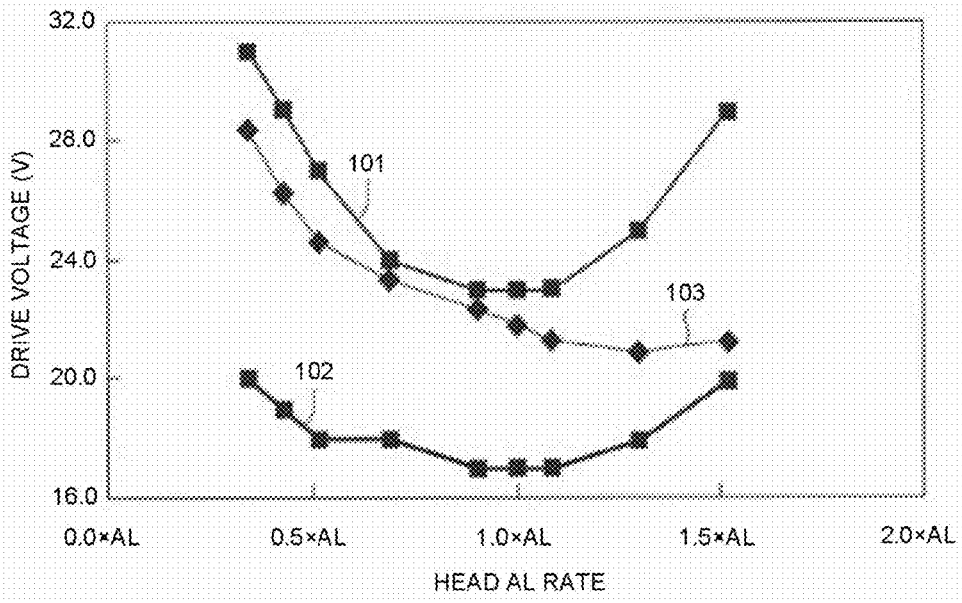
FIG. 4 is a graph illustrating a relationship between an expansion pulse width and a drive voltage according to the embodiment.

In the example shown by FIG. 3, the control section 20 continuously applies four ejection pulses to the actuator. Furthermore, the number of the ejection pulses continuously applied by the control section 20 is not limited to a specific number Next, a relationship between the width of the expansion pulse and the drive voltage applied to the actuator is described. FIG. 4 is a graph illustrating the relationship between the width of the expansion pulse and the drive voltage applied to the actuator. The horizontal axis indicates the width of the expansion pulse by taking the AL as the reference. The vertical axis indicates the drive voltage applied to the actuator.

A graph 101 indicates an upper limit voltage at which the ink can be ejected from the pressure chamber formed by the actuator. In other words, even if a drive voltage larger than the graph 101 is applied to the actuator, the ink is not ejected from the pressure chamber.

A graph 102 indicates a lower limit voltage at which the ink can be ejected from the pressure chamber formed by the actuator. In other words, even if a drive voltage smaller than the graph 102 is applied to the actuator, the ink is not ejected from the pressure chamber.

A graph 103 is a drive voltage at which a desired amount of ink can be ejected. In other words, if the control section 20 applies a drive voltage indicated by the graph 103 to the actuator, a desired amount of ink can be ejected.

The smaller the width of the expansion pulse is, the more the phase and the amplitude of the residual vibration are reduced. Thus, the smaller the width of the expansion pulse is, the more the ejection failure can be suppressed. On the other hand, as shown by FIG. 4, the smaller the width of the expansion pulse becomes, the larger the drive voltage (graph 103) at which a desired amount of ink can be ejected becomes. In particular, if the width of the expansion pulse is over 0.4 times of the AL, the drive voltage at which a desired amount of ink can be ejected is increased sharply.

Thus, it is desired that the width of the expansion pulse is about 0.4 times-0.9 times as large as the AL. Further, if the width of the expansion pulse is 0.5 times as large as the AL, the drive voltage at which a desired amount of ink can be ejected is relatively small, and the influence of residual vibration can also be suppressed.

Figure 5:
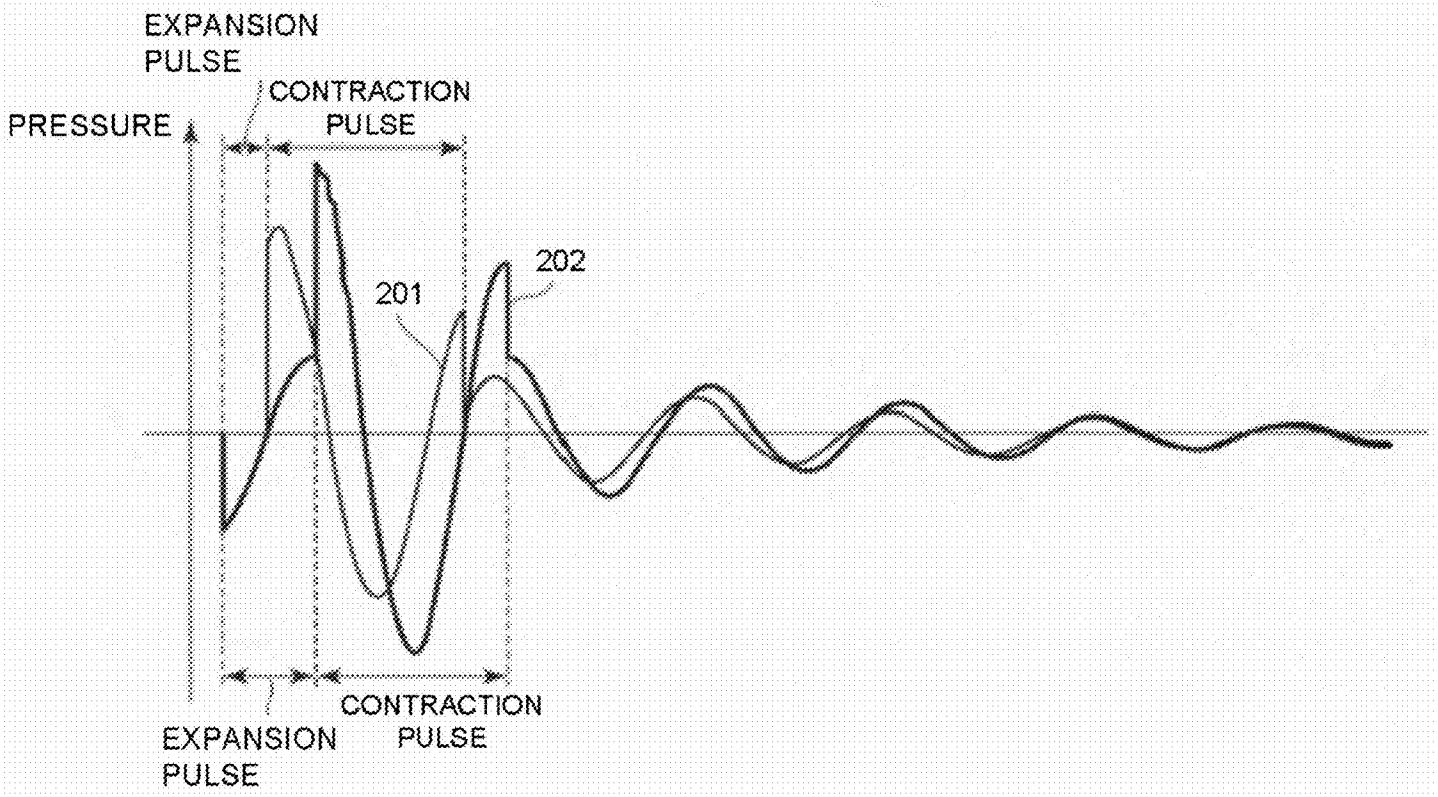
FIG. 5 is a graph illustrating pressure in a pressure chamber according to the embodiment.

Next, the residual vibration is described. The width of the expansion pulse is set as 0.5 AL. FIG. 5 is a graph illustrating an example of the residual vibration. The horizontal axis indicates elapsed time. The vertical axis indicates pressure in the pressure chamber.

A graph 201 indicates an example of applying an ejection pulse of which the width of the expansion pulse is 0.5 AL. In other words, the graph 201 indicates the residual vibration in a case in which the control section 20 applies an expansion pulse with the width of 0.5 AL and a contraction pulse with the width of 2 AL as the ejection pulse.

A graph 202 indicates an example of applying an ejection pulse of which the width of the expansion pulse is AL. In other words, the graph 201 indicates the residual vibration in a case in which the control section 20 applies an expansion pulse with the width of AL and a contraction pulse with the width of 2 AL as the ejection pulse. Furthermore, as the pause period is sufficiently smaller than the widths of the expansion pulse and the contraction pulse, the pause period is ignored in FIG. 5.

As shown by FIG. 5, in the graphs 201 and 202, the pressure at a timing at which the expansion pulse is applied drops discontinuously and then rises gradually. Further, the pressure at a timing at which the contraction pulse is applied rises discontinuously and then oscillates. Further, the pressure at a timing at which the application of the contraction pulse is ended drops discontinuously and then oscillates As shown by FIG. 5, the amplitude of the graph 201 contracts quickly than the amplitude of the graph 202. In other words, the residual vibration of the graph 201 contracts quickly than the residual vibration of the graph 202. Thus, the residual vibration in a case in which the control section 20 applies the ejection pulse of which the width of the expansion pulse is 0.5 AL contracts quickly than that in a case in which the control section 20 applies the ejection pulse of which the width of the expansion pulse is AL, and it can be said that the influence of the residual vibration becomes small.

Figure 6:
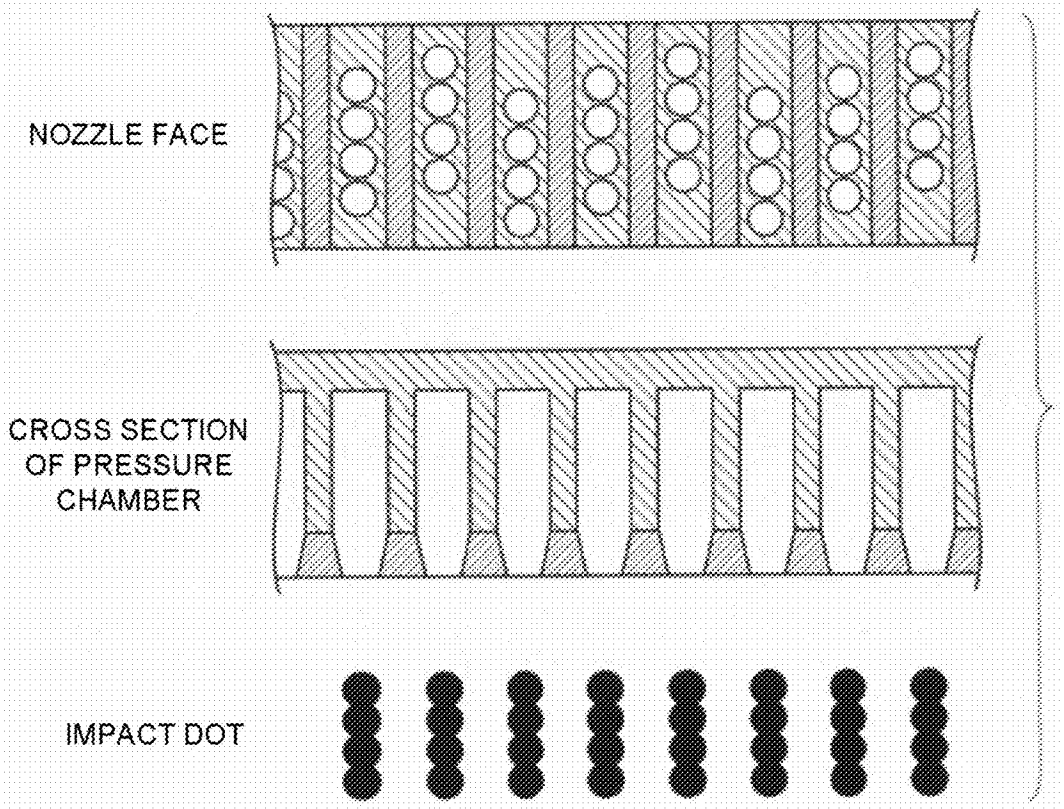
FIG. 6 is a diagram illustrating ideal impact according to the embodiment.

Next, ink impacted onto the print medium S is described. FIG. 6 illustrates an example of a case of ideal impact. As shown by FIG. 6, a plurality of nozzles forms rows to be arranged on a nozzle face (nozzle plate face). Further, all the rows are arranged shifted in the row direction. Further, rows belonging to the same division are arranged at the same position in the row direction.

Further, as shown by the cross section of the pressure chamber, adjacent pressure chambers supply the actuator. Further, the control section 20 ejects ink from each division in order in accordance with the conveyance speed of the print medium S. as a result, impact dots are formed at the same position in the row direction on the print medium S.

Figure 7:
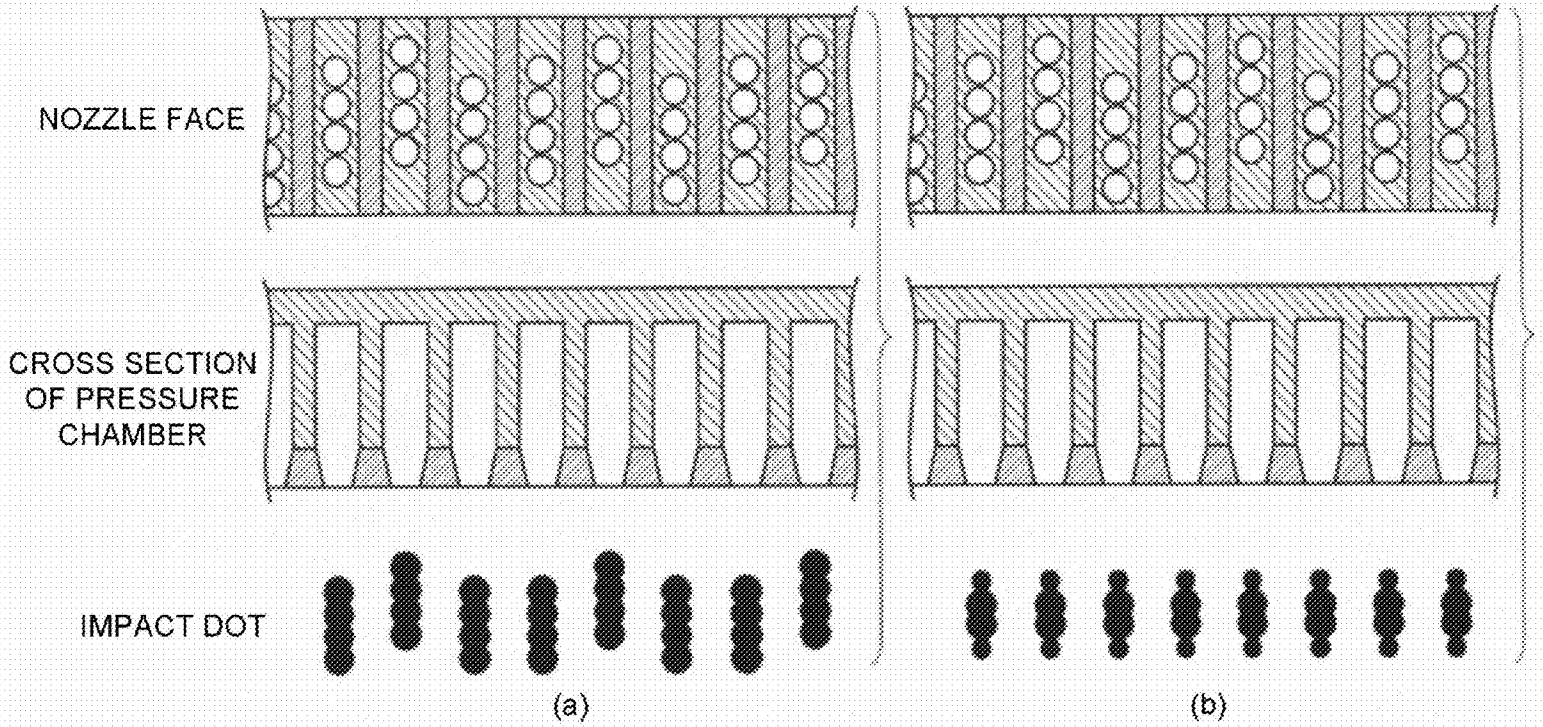
FIG. 7 is a cross-sectional view illustrating impact receiving the influence of residual vibration according to the embodiment.

Next, an example of a case of receiving the influence of the residual vibration is illustrated. FIG. 7 illustrates the example of the case of receiving the influence of the residual vibration. The example shown by FIG. 7(*a*) is an example of a case in which an ejection speed of the ink is not stable due to the residual vibration. As the ejection speed is not stable, the ink is not impacted to a desired position on the print medium S. As a result, as shown by FIG. 7(*a*), the impact dots ejected from each division are formed at positions different from each other in the row direction.

The example shown by FIG. 7(*b*) is an example of a case in which an ejection amount of the ink is not stable due to the residual vibration. As the ejection amount of the ink is not stable, the size of the dot on the print medium S is not stable. As a result, as shown by FIG. 7(*b*), the sizes of the respective impact dots are different from each other.

Next, another example of the drive voltage applied to the actuator by the control section 20 is described.

Figure 8:
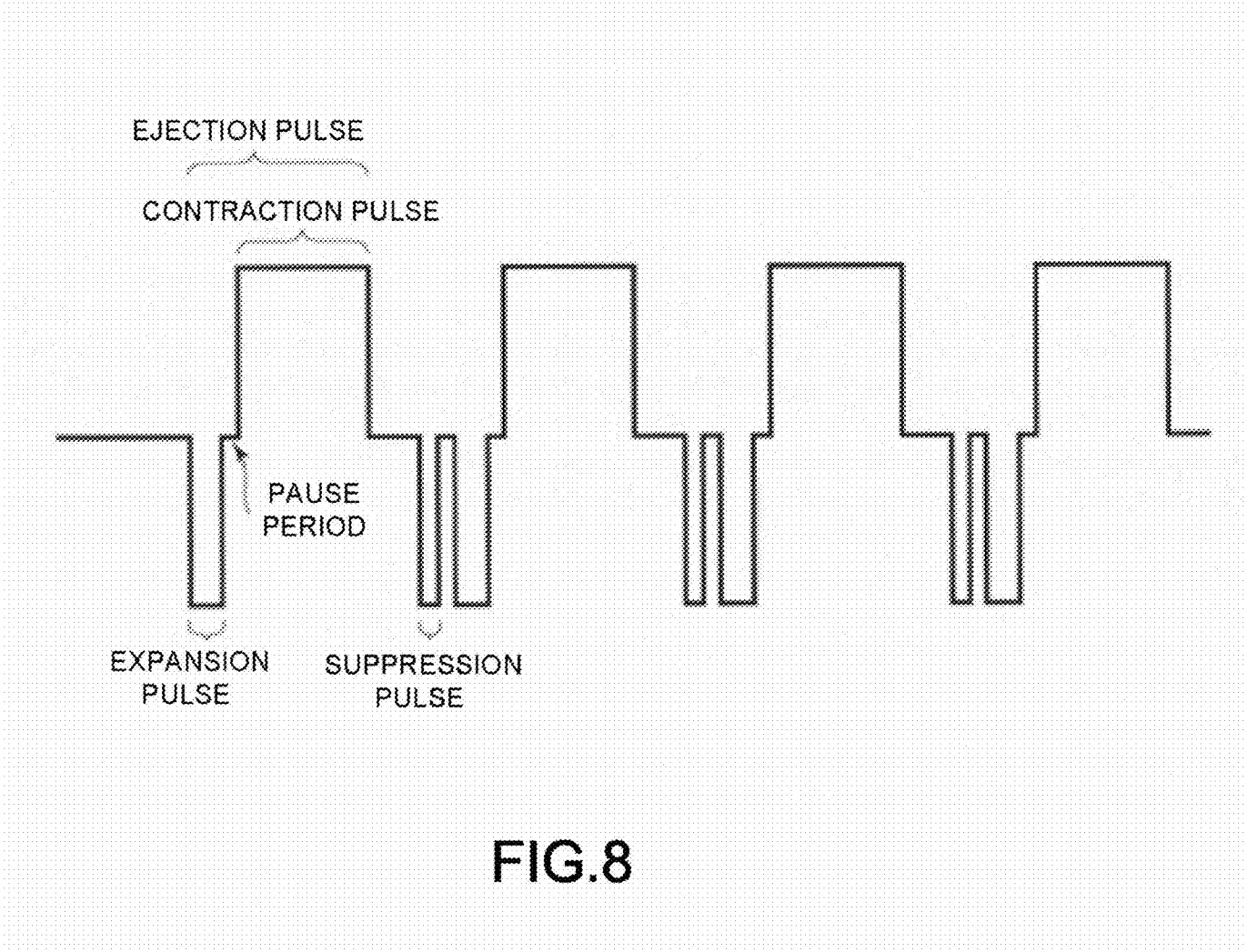
FIG. 8 is a diagram illustrating another example of the voltage waveform applied to the electrode according to the embodiment.

FIG. 8 is a diagram illustrating another example of the drive voltage applied to the actuator by the control section 20. As shown by FIG. 8, the control section 20 applies a suppression pulse at a predetermined interval after applying the ejection pulse.

The suppression pulse is used for suppressing the residual vibration generated from the ejection pulse. For example, the suppression pulse drives the actuator in a direction of the expansion of the pressure chamber. In other words, the drive voltage of the suppression pulse has the same polarity as the drive voltage of the expansion pulse. For example, the suppression pulse has a width smaller than the expansion pulse. Further, the voltage of the suppression pulse is smaller than that of the expansion pulse. Further, the suppression pulse is a rectangular pulse. The constitution of the suppression pulse is not limited to the specific constitution.

The control section 20 applies a next ejection pulse at a predetermined interval after applying the suppression pulse. Furthermore, the control section 20 may apply a suppression pulse every few ejection pulses. Further, the control section 20 may apply a plurality of the suppression pulses from a moment the ejection pulse is applied to a moment the next ejection pulse is applied.

The inkjet head constituted as stated above can suppress the residual vibration generated from the ejection pulse by reducing the width of the expansion pulse. Further, the inkjet head can set a relatively small drive voltage by setting the width of the expansion pulse to about 0.5 AL. As a result, the inkjet head can easily suppress the ejection failure caused by the residual vibration.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An inkjet head, comprising:

a first actuator and a second actuator;

a nozzle plate formed over the first actuator and the second actuator;

a pressure chamber formed inside the first actuator, the second actuator, and the nozzle plate, wherein the pressure chamber is configured to house ink, and wherein the first actuator and the second actuator are configured to be driven, by an electrode, to expand or contract a volume of the pressure chamber in order to eject the ink from an opening of the pressure chamber; and a control section configured to:

apply an expansion pulse to the electrode based on a first output of a drive signal for driving in a direction in which the volume of the pressure chamber is expanded to the first actuator and the second actuator, the expansion pulse having a width from 0.4 times to 0.9 times of a period AL, which is half a vibration period during which nozzle negative pressure is changed in the pressure chamber, and apply a contraction pulse to the electrode based on a second output of the drive signal for driving in a direction in which the volume of the pressure chamber is contracted to the first actuator and the second actuator.

2. The inkjet head according to claim 1, wherein the width of the contraction pulse is at least twice of the period AL.

3. The inkjet head according to claim 1, wherein the width of the expansion pulse is 0.5 times of the period AL.

4. The inkjet head according to claim 2, wherein the width of the expansion pulse is 0.5 times of the period AL.

5. The inkjet head according to claim 1, wherein the control section applies a suppression pulse for suppressing residual vibration of the pressure chamber to the first actuator and the second actuator after applying the contraction pulse.

6. The inkjet head according to claim 1, wherein the first actuator comprises a first piezoelectric element bonded to a second piezoelectric element; and the second actuator comprises the first piezoelectric element bonded to a third piezoelectric element.

7. The inkjet head according to claim 6, wherein the first piezoelectric element has a polarization direction opposite to another polarization direction of the second piezoelectric element.

8. The inkjet head according to claim 1, wherein the control section comprises a control signal generation section for generating a waveform pattern of a drive voltage and a transistor for applying voltages to electrodes, including the electrode, according to the waveform pattern.

9. An inkjet printer, comprising:

a conveyance section configured to convey a medium serving as an adhesion object of ink; and an inkjet head, comprising:

a pressure chamber configured to house the ink;

a first actuator and a second actuator configured to be driven, by an electrode, to expand or contract a volume of the pressure chamber in order to eject the ink from an opening of the pressure chamber, wherein the pressure chamber is formed inside the first actuator, the second actuator, and a nozzle plate; and a control section configured to:

apply an expansion pulse to the electrode based on a first output of a drive signal for driving in a direction in which the volume of the pressure chamber is expanded to the first actuator and the second actuator, the expansion pulse having a width from 0.4 times to 0.9 times of a period AL, which is half a vibration period during which nozzle negative pressure is changed in the pressure chamber, and apply a contraction pulse to the electrode based on a second output of the drive signal for driving in a direction in which the volume of the pressure chamber is contracted to the first actuator and the second actuator.

10. The inkjet printer according to claim 9, wherein the width of the contraction pulse is at least twice of the period AL.

11. The inkjet printer according to claim 9, wherein the width of the expansion pulse is 0.5 times of the period AL.

12. The inkjet printer according to claim 10, wherein the width of the expansion pulse is 0.5 times of the period AL.

13. The inkjet printer according to claim 9, wherein the control section applies a suppression pulse for suppressing residual vibration of the pressure chamber to the first actuator and the second actuator after applying the contraction pulse.

14. The inkjet printer according to claim 9, wherein the first actuator comprises a first piezoelectric element bonded to a second piezoelectric element; and the second actuator comprises the first piezoelectric element bonded to a third piezoelectric element.

15. The inkjet printer according to claim 14, wherein the first piezoelectric element has a polarization direction opposite to another polarization direction of the second piezoelectric element.

16. The inkjet printer according to claim 9, wherein the control section comprises a control signal generation section for generating a waveform pattern of a drive voltage and a transistor for applying voltages to electrodes, including the electrode, according to the waveform pattern.

17. A method of mitigating influence of a residual vibration generated in a pressure chamber of an inkjet head, comprising:

driving an actuator to expand or contract a volume of the pressure chamber in order to eject ink from an opening of the pressure chamber;

expanding the pressure chamber to the actuator based on applying an expansion pulse to an electrode that drives the actuator, wherein the applying the expansion pulse comprises outputting a first drive signal for driving in a direction in which the volume of the pressure chamber is expanded to the actuator, the expansion pulse having a width from 0.4 times to 0.9 times of a period AL, which is half a vibration period during which nozzle negative pressure is changed in the pressure chamber; and contracting the pressure chamber to the actuator based on applying a contraction pulse to the electrode based on outputting a second drive signal for driving in a direction in which the volume of the pressure chamber is contracted to the actuator.

18. The method according to claim 17, wherein the width of the contraction pulse is at least twice of the period AL.

19. The method according to claim 17, wherein the width of the expansion pulse is 0.5 times of the period AL.

20. The method according to claim 17, further comprising:

applying a suppression pulse to the actuator after applying the contraction pulse.

* * * * *